US005421119A

United States Patent [19]

Miner

[11] Patent Number: 5,421,119

[45] Date of Patent: Jun. 6, 1995

[54] RIFLE FIRING PIN

[76] Inventor: Donald W. Miner, 16141 SW. Taylor La., Tigard, Oreg. 97224

[21] Appl. No.: 251,690

[22] Filed: May 31, 1994

[51] Int. Cl.[6] ..... F41A 19/13

[52] U.S. Cl. ..... 42/69.01; 89/132

[58] Field of Search ..... 42/69.01, 69.02, 69.03; 89/132, 135

[56] References Cited

U.S. PATENT DOCUMENTS

| | | | |
|---|---|---|---|
| 2,425,434 | 8/1947 | Loomis | 89/132 |
| 3,056,226 | 10/1962 | Hubbard et al. | 42/69.02 |
| 3,670,442 | 6/1972 | Kennedy et al. | 42/69.03 |
| 4,194,314 | 3/1980 | Foote | 42/25 |
| 4,246,830 | 1/1981 | Krieger | 89/132 |

OTHER PUBLICATIONS

Advertisement for Titanium Firing Pins For Pistols, published in *Front Sight Magazine,* Jul./Aug. 1993, p. 76.

Titanium Firing Pins For Pistols, *Brownells* Catalog, #46, Aug. 1993, p. 8.

*Primary Examiner*—Charles T. Jordan
*Assistant Examiner*—Theresa M. Wesson
*Attorney, Agent, or Firm*—Stoel Rives Boley Jones & Grey

[57] ABSTRACT

An M16/AR-15 rifle firing pin of a unitary titanium construction includes a head section with a head that a rifle hammer hits to drive the firing pin against the primer of a cartridge. The head section includes a shoulder with a radially outer edge. The shoulder preferably has a chamfer along the radially outer edge facing the head section.

6 Claims, 1 Drawing Sheet

RIFLE FIRING PIN

TECHNICAL FIELD

The present invention relates to rifle firing pins and, in particular, to an improved rifle firing pin for M16/AR-15 rifles.

BACKGROUND OF THE INVENTION

A firearm discharges a cartridge to fire a bullet by striking the primer of the cartridge with a firing pin positioned within the bolt of the firearm. The primer is ignited by striking it with sufficient force. The ignited primer ignites gunpowder in the cartridge to propel the bullet toward a target.

The firing pin is driven toward the primer along a firing pin well in the bolt. For example, a spring-loaded hammer strikes a head of the firing pin and drives it along the firing pin well toward the cartridge primer. A striker point at one end of the firing pin strikes the primer to ignite it and fire the cartridge.

M16/AR-15 rifles are used worldwide by military and law enforcement organizations and civilian sport enthusiasts. M16 and AR-15 rifles are substantially the same, except that the former is switchable between automatic and semi-automatic operation and the latter operates only in the semi-automatic mode. As a result, most of the components of M16 and AR-15 rifles, including the firing pins, are substantially the same and are preferred to as M16/AR-15 components.

FIG. 1 is a side elevation of a conventional heat-treated steel M16/AR-15 rifle firing pin 10 having at one end a cylindrical striker section 12 with a striker point 14 for striking a primer of a cartridge (not shown) and at another end a head section 16 with a head 18 that a rifle hammer hits to drive firing pin 10 against the cartridge.

Head section 16 includes a shoulder 20 with a radially outer edge 22 that is formed perpendicular to the plane of shoulder 20 for ease of manufacturability. In AR-15 rifles, shoulder 22 functions to recock the hammer as the bolt returns after a cartridge is fired. An elongate cylindrical central body section 24 is positioned between striker section 12 and head section 16. Striker section 12 and central body section 24 are of first and second diameters 26 and 28, respectively, first diameter 26 being less than second diameter 28.

Although M16/AR-15 rifles are typically quite reliable and accurate, they can suffer from some disadvantages. For example, while accurate at moderate ranges within about 300 meters, M16/AR-15 rifles are not as accurate as other weapons at ranges greater than about 300 meters.

In addition, M16/AR-15 rifles sometimes exhibit an extremely dangerous condition called "slam fire," in which the weapon inadvertently discharges when a cartridge or round is loaded into the chamber of the weapon (referred to as chambering). Incidental to the normal chambering of a cartridge, the firing pin strikes the cartridge primer with a force that is intended to be insufficient to ignite the primer. A slam fire occurs when the primer is ignited and the cartridge discharged by the incidental strike of the firing pin against the primer. It will be appreciated that slam fire can pose an extreme danger to bystanders when a cartridge is chambered in these weapons.

SUMMARY OF THE INVENTION

An object of the present invention is, therefore, to provide an M16/AR-15 rifle firing pin.

Another object of this invention is to provide such a firing pin that reduces the susceptibility of M16/AR-15 rifles to slam fire.

A further object of this invention is to provide such a firing pin that improves the accuracy of M16/AR-15 rifles, particularly at long range.

The present invention includes an M16/AR-15 rifle firing pin of a unitary titanium construction. For compatibility with an M16/AR-15 rifle, a firing pin of this invention has the same general configuration and dimensions as a conventional steel M16/AR-15 rifle firing pin and includes generally similar head, striker, and central body sections. In a preferred embodiment, however, the shoulder on a firing pin of this invention includes a chamfer along the radially outer edge facing the head section.

An M16/AR-15 rifle firing pin of the present invention has substantially less weight than a conventional steel firing pin and travels smoothly along the firing pin well in the bolt of the firearm. The weight reduction reduces susceptibility to slam fire by reducing the force with which the firing pin incidentally strikes a cartridge primer when the cartridge is chambered.

The reduced weight of the firing pin also allows it to travel along its well faster when struck by the hammer, thereby reducing the lock time between the pull of the trigger and the strike of the firing pin against the primer. This reduced lock time can improve the accuracy of the weapon at long range by increasing the likelihood that the cartridge is fired while the target is in the marksman's sight picture.

A conventional perpendicular shoulder on an M16/AR-15 rifle firing pin of a unitary titanium construction has been found to develop undesirable nicks along the shoulder edge facing the head section when used in AR-15 rifles. These nicks result from the use of the shoulder to recock the hammer and the relative softness of titanium in comparison to the heat-treated steel of a conventional firing pin. Such nicks are indicative of undesirable wear of the firing pin. However, such firing pins used in M16 rifles do not develop nicks in the shoulder because it is not used to recock the hammer.

An M16/AR-15 rifle firing pin of a unitary titanium construction and having a chamfer along the radially outer edge of the shoulder does not exhibit the nicks or wear of a titanium firing pin with a conventional perpendicular shoulder. It is believed that the reduction of evident wear is also indicative of smoother motion of the firing pin within the bolt and reduced variation in the locations at which the firing pin strikes the primers of cartridges, thereby improving the accuracy of the firearm.

Additional objects and advantages of the present invention will be apparent from the detailed description of a preferred embodiment thereof, which proceeds with reference to the accompanying drawings.

DETAILED DESCRIPTION OF PREFERRED EMBODIMENT

Figure 2:
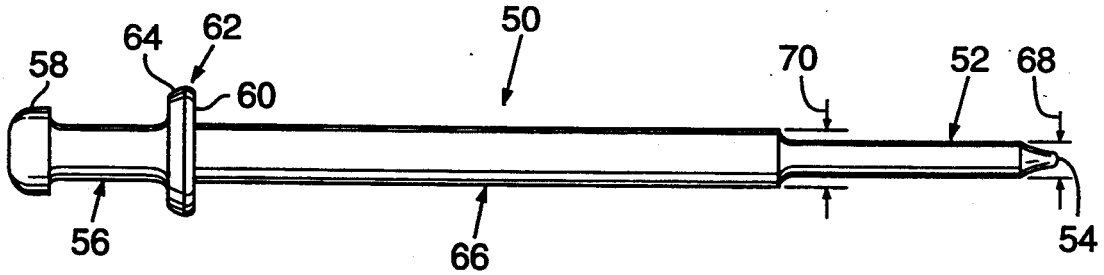
FIG. 2 is a side elevation of a titanium M16/AR15 rifle firing pin of the present invention.
Figure 3:
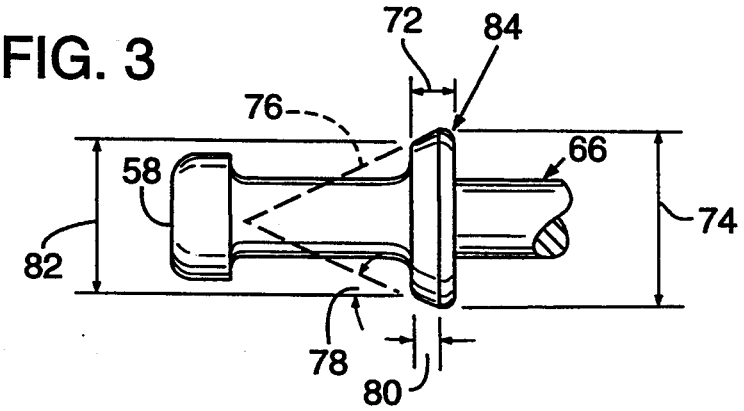
FIG. 3 is an enlarged side elevation of a head section of the firing pin of FIG. 2.

Referring to FIGS. 2 and 3, a unitary titanium M16/AR-15 rifle firing pin 50 of the present invention is shown. A cylindrical striker section 52 with a striker point 54 for striking a primer of a cartridge (not shown) is positioned at one end of firing pin 50. A head section 56 with a head 58 that a rifle hammer hits to drive firing pin 50 against the cartridge is positioned at the other end of firing pin 50.

Figure 1:
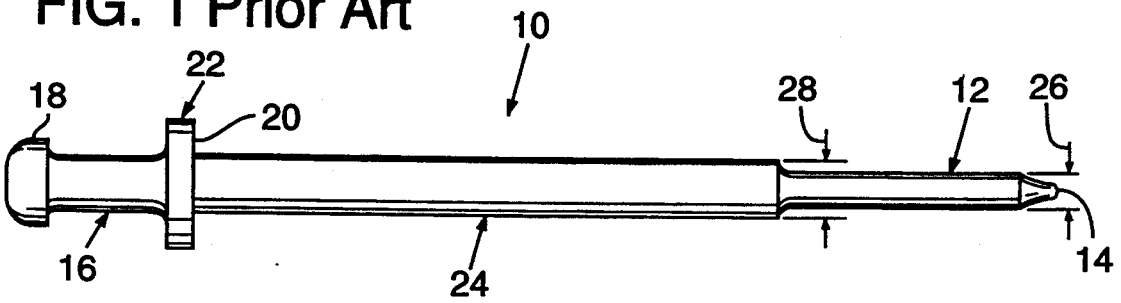
FIG. 1 Prior Art
FIG. 1 is a side elevation of a conventional prior art steel M16/AR-15 rifle firing pin.

Head section 56 includes a shoulder 60 with a radially outer edge 62 having a chamfer 64 facing head 58. An elongate cylindrical central body section 66 is positioned between striker section 52 and head section 56. Striker section 52 and central body section 66 are of respective diameters 68 and 70, diameter 68 being less than diameter 70. For compatibility with M16/AR-15 rifles, firing pin 50 has a configuration, dimensions, and tolerances that are substantially the same as those of conventional steel M16/AR-15 firing pin 10 of FIG. 1, except with regard to shoulder 60 and chamfer 64. The configuration, dimensions, and tolerances of firing pin 10 are known by persons skilled in the art.

As with shoulder 20 of firing pin 10, shoulder 60 of firing pin 50 has a thickness 72 of 0.075 inch (1.91 mm) and an outer diameter 74 of 0.365 inch (9.27 mm). Preferably, chamfer 64 forms along radially outer edge 62 of shoulder 60 a conical section corresponding to a cone 76 (shown in outline) that forms relative to a perpendicular from shoulder 60 an angle 78 of between 22° and 26°, preferably about 24°. Angle 78 of chamfer 64 approximately matches the angle of the AR-15 rifle structure shoulder 60 engages to recock the hammer of the rifle.

Chamfer 64 is formed over a thickness 80 of 0.050 inch (1.27 mm) of shoulder 60 and provides it with a head-facing diameter 82 of 0.320 inch (8.13 mm) where chamfer 64 is blended with or rounded to shoulder 60 with a radius of 0.015 inch (0.38 mm). As a result, a portion 84 of radially outer edge 62 is not chamfered, but rather is blended with or rounded to shoulder 60 a radius of 0.020 inch (0.51 mm). Firing pin 50 has about 60% the weight of conventional steel firing pin 10 and superior corrosion resistance. Firing pin 50 is formed by machining a rod of surgical grade titanium on a swiss-type screw machine with computer/numerical controls.

It will be appreciated that chamfer 64 could be formed over different thicknesses of shoulder 60 and at different angles and that the rounding of chamfer 64 to shoulder 60 could be varied or eliminated. Moreover, a firing pin 50 without chamfer 64 on shoulder 64 may be used in an M16 rifle without undergoing excessive wear while providing reduced lock time and reduced susceptibility to slam fire.

It will be obvious to those having skill in the art that many changes may be made in the above-described details of a preferred embodiment of the present invention without departing from the underlying principles thereof. The scope of the invention should, therefore, be determined only by the following claims.

I claim:

1. In an M16/AR-15 rifle firing pin having at opposed ends a cylindrical striker section with a striker point for striking a primer of a cartridge and a head section with a head that a rifle hammer strikes to drive the firing pin toward the cartridge, the head section including a shoulder separate from the head for engaging a rifle recocking structure for recocking the rifle hammer, an elongate cylindrical central body section being positioned between the head section and the striker section, the striker section and central body section being of respective first and second diameters, the first diameter being less than the second diameter, the improvement comprising:

a unitary titanium construction of the firing pin; and a chamfer along a radially outer edge of the shoulder and facing the head for engaging the rifle recocking structure.

2. The firing pin of claim 1 in which the chamfer forms along the radially outer edge of the shoulder a conical section corresponding to a cone that forms relative to a perpendicular from the shoulder an angle of between 22° and 26°.

3. The firing pin of claim 2 in which the angle is about 24°.

4. In an M16/AR-15 rifle firing pin having at opposed ends a cylindrical striker section with a striker point for striking a primer of a cartridge and a head section with a head that a rifle hammer strikes to drive the firing pin toward the cartridge, the head section including a shoulder separate from the head and having a radially outer edge, the shoulder being configured to engage a rifle recocking structure for recocking the rifle hammer, an elongate cylindrical central body section being positioned between the head section and the striker section, the striker section and central body section being of respective first and second diameters, the first diameter being less than the second diameter, the improvement comprising:

a chamfer formed in the radially outer edge of the shoulder and facing the head for engaging the rifle recocking structure.

5. The firing pin of claim 4 in which the chamfer forms along the radially outer edge of the shoulder a conical section corresponding to a cone that forms relative to a perpendicular from the shoulder an angle of between 22° and 26°.

6. The firing pin of claim 5 in which the angle is about 24°.

* * * * *